United States Patent [19]

Sardo

[11] 4,364,479

[45] Dec. 21, 1982

[54] AUTOMATIC MACHINE FOR SORTING OUT ROUND, OVAL OR FLAT FRUIT IN ACCORDANCE WITH THEIR DIAMETER

[75] Inventor: Alberto Sardo, Le Chesnay, France

[73] Assignee: Xeda International S.A., Le Chesnay, France

[21] Appl. No.: 205,615

[22] Filed: Nov. 10, 1980

[30] Foreign Application Priority Data

Dec. 21, 1979 [IT] Italy ..... 12871 A/79

[51] Int. Cl.[3] ..... B07B 13/075

[52] U.S. Cl. ..... 209/668

[58] Field of Search ..... 209/659, 660, 665, 667, 209/668, 673

[56] References Cited

U.S. PATENT DOCUMENTS 3,545,612 12/1970 Mumma ..... 209/622

FOREIGN PATENT DOCUMENTS 25232 6/1952 Finland ..... 209/665
1105584 7/1955 France ..... 209/665
1387948 12/1964 France ..... 209/665
730029 5/1955 United Kingdom ..... 209/665

*Primary Examiner*—Robert B. Reeves

[57] ABSTRACT

The machine comprises a continuous conveyor having rollers which are parallel to each other and equally spaced apart and define gaps therebetween. In each of the gaps there is disposed another roller which is parallel to and equally spaced from said rollers. This other roller is movable upwardly or downwardly and cooperates with independent and adjustable guides. The fruit is sorted out by using at least the upper reach of the conveyor in which the various rollers rotate in the desired direction and at suitable speed and in which the movable rollers are moved by guide means progressively away from the fixed rollers as the rollers advance toward the end of the upper reach of the conveyor. The lower reach of the conveyor is either guided in such manner as to avoid rotating the movable rollers and fixed rollers or guided so that the movable rollers are again progressively moved away from the fixed rollers as the latter and the movable rollers are rotated. The latter arrangement doubles the output of the machine.

2 Claims, 3 Drawing Figures

T1
F1
F2
F3
F4
Z
A
A'

AUTOMATIC MACHINE FOR SORTING OUT ROUND, OVAL OR FLAT FRUIT IN ACCORDANCE WITH THEIR DIAMETER

DESCRIPTION

Machines are known for sorting out fruit in accordance with their diameter which comprise a conveyor having rollers which are parallel and contained in the same plane, the distance between the rollers varying progressively, at least during the travel of the conveyor in the upper reach thereof, between an initial minimum value and a final maximum value. The fruit which is initially placed in cavities defined by the gaps between one roller and the following, fall onto subjacent discharging bands when, owing to the progressive increase in the distance between the rollers, each cavity has a width which is at least equivalent to the diameter of the fruit disposed in this cavity.

In machines of this type, it is also known to rotate the rollers during the translation of the conveyor in the upper reach thereof so that the fruit rotate about their polar axis and are consequently calibrated in accordance with their equatorial circumference.

The following drawbacks are encountered in these machines:

- constructional and operational complications which result from the necessity to compensate for the lengthening or shortening of the conveyor chains carrying the rollers owing to variation in the distance between the rollers;
- owing to the aforementioned complications, it is difficult to reach high operational speeds and consequently a high rotational speed of the rollers so that flat fruit, such as tangerines, are difficult to sort out;
- also, owing to said complications, it is difficult to operate with very high outputs unless a machine of very great width is constructed;
- fruit which have an irregular equatorial circumference may be damaged during the sorting out since, owing to the arrangement of the rollers in the same plane, the force of gravity tends to wedge the fruit in the empty space between these rollers.

An object of the invention is to overcome these drawbacks and other drawbacks by providing a new sorting out machine.

The features and advantages of the invention will be apparent from the ensuing description with reference to the accompanying drawing which is given solely by way of example and in which.

Figures 1, 2, 3:
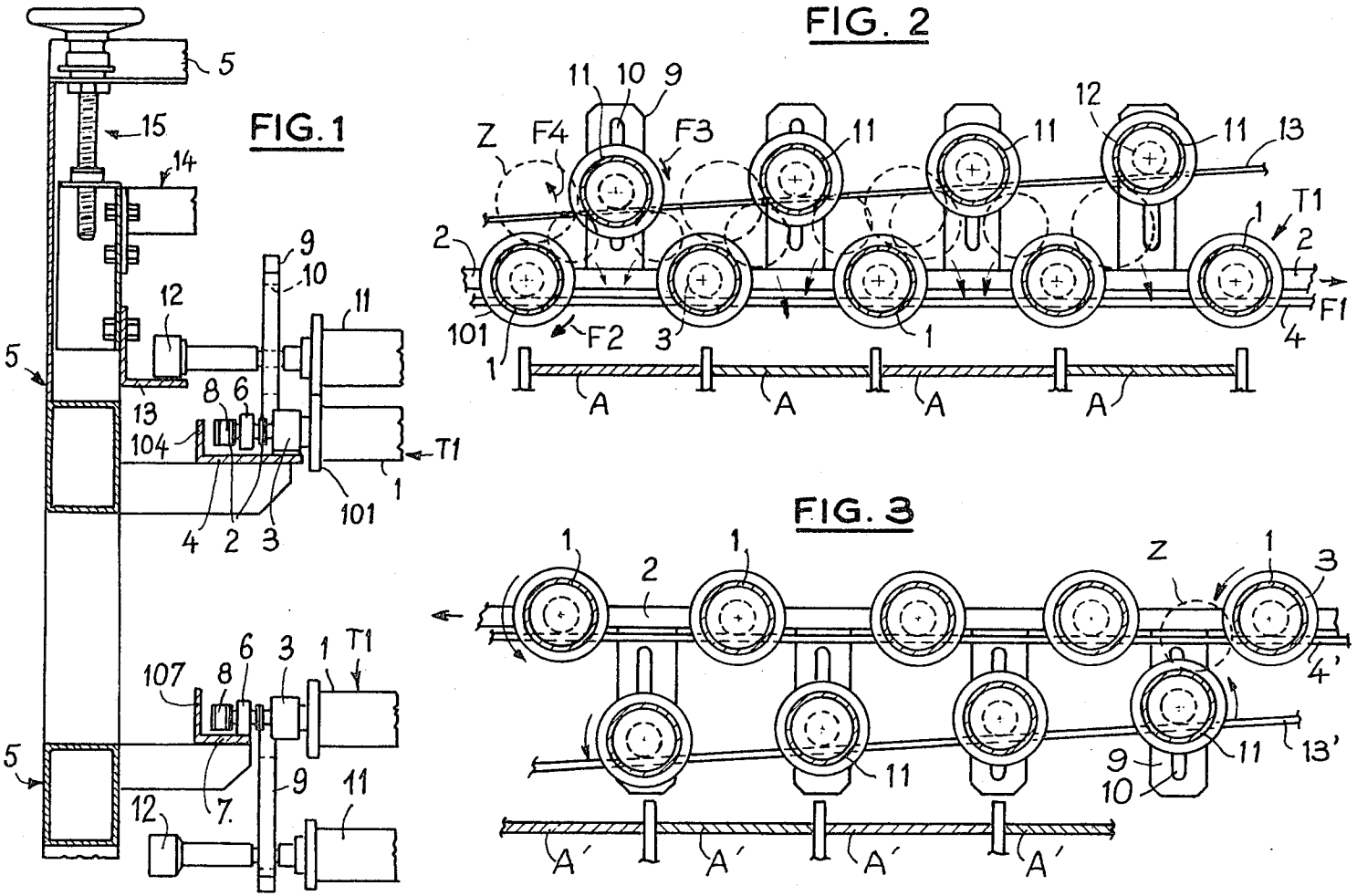
FIG. 1 is a partial cross-sectional view of a sorting out machine according to one embodiment of the invention.
FIG. 2 is a partial and longitudinal sectional view of the upper reach of the machine shown in FIG. 1.
FIG. 3 is a partial and longitudinal sectional view of the lower reach of the conveyor of a second embodiment of the invention.

With reference first to FIGS. 1 and 2, it will be observed that the machine comprises a conveyor T1 having rollers 1 which are parallel to each other and equally spaced apart. Reference numeral 2 designates chains which carry the ends of the rollers which are rotatable relative to the chains and the reference numeral 3 designates wheels which have a suitable diameter and are keyed on the ends of the shafts of the rollers 1 and which, in the path of the upper reach of the conveyor T1, bear and roll against horizontal guides 4 fixed to the frame 5 of the machine. Owing to the cooperation between the wheels 3 and the guides 4 and to the translation of the upper reach of the conveyor T1, for example in the direction indicated by arrow F1 from one end of the conveyor to the opposite end of the conveyor, the rollers 1 rotate in the direction indicated by arrow F2.

Also mounted on end portions of the shaft of each roller 1 are rolling bearings 6 which, in the path of the lower reach of the conveyor T1, bear and roll against horizontal guides 7 fixed to the frame 5 (FIG. 1). In the travel through the path of this lower reach of the conveyor, the rollers 1 therefore do not rotate. It must be understood that the rolling bearing 6 may normally be an integrated part of the chains 2. On the outer side of the chains 2 and, for example, in the region of the ends of the shafts of the rollers 1, there may also be fixed shoes 8 of suitable shape and material which may cooperate with upstanding flanges 104 and 107 of the guides 4 and 7 and thus ensure that the two reaches of the conveyor T1 travel in a perfectly straight line.

The rollers 1 are preferably provided with an elastically yieldable and flexible material on their outer face and have, at their ends, annular beads 101 which exert a retaining action on the fruit to be sorted out, as will be described hereinafter. Fixed to the intermediate portion of each segment of the chain 2 located between two consecutive rollers 1, is a vertical plate 9 which has a vertical slot 10 of appropriate width. Extending through the slots are splined end portions of shafts of rollers 11 which are similar to the rollers 1 and are consequently disposed to be parallel to the rollers 1. Keyed on the end portions of the shafts of the rollers 11 are also wheels 12 of suitable diameter which, during the travel through the path of the upper reach of the conveyor, bear and roll against guides 13 so that the rollers 11 rotate in the same direction and at the same speed as the rollers 1 (arrow F3). During the travel through the path of the lower reach of the conveyor T1, the wheels 12 are not supported so that the rollers 11 do not rotate. The guides 13 are carried by supports 14 forming cross-beams combined with the frame 5 of the machine by regulating means 15, for example of the screw-and-nut type. By acting on the regulating means 15, the guides 13 may be given a suitable inclination in the upward direction or a suitable divergence relative to the guides 4, when the latter are viewed in the direction of travel of the conveyor T1 in the upper reach thereof. Consequently, in the course of the travel of the conveyor in the upper reach thereof, the rollers 11 are located at a minimum distance from the rollers 1 and this distance progressively increases until a predetermined maximum value is reached, as the rollers advance toward the end of this upper reach. When the fruit Z is introduced in the initial part of the upper reach of the conveyor T1, this fruit is disposed in cavities formed by the gaps between the rollers 1 and 11 and turn in the direction indicated by arrow F4 when they come into contact with the rollers along their equatorial circumference. As soon as the equatorial diameter of the fruit is equal to the distance between the rollers 1 and 11, the fruit drops below the upper reach of the conveyor T1 where conveyors of known type A are provided. These known conveyors receive the fruit which is distributed in different sizes and conveys the fruit to receiving and packing stations.

The advantages afforded by the machine described hereinbefore may be summarized as follows:

the machine is simple in construction also because it does not require any compensation as in the case of sorting out machines of known type having rollers located in the same plane, and it can consequently operate at a high speed with a corresponding high output of the treated product;

the high speed of translation of the rollers 1 and 11 implies a correspondingly high speed of rotation of these rollers and the machine is consequently also particularly adapted for the calibration or sorting out of flat fruit such as tangerines;

the fruit has less tendency to become wedged in the cavities between the rollers 1 and 11, since they are well supported by the rollers 1 in the direction opposing the direction of the force of gravity and in this way there is less risk of causing mechanical deterioration of the fruit which usually occurs in respect of fruit calibrated in machines of known type.

Instead of being rectilinear, the guides 13 may have a broken-line or zig-zag configuration in the longitudinal direction so that the variation in the distance between the rollers 1 and 11 occurs in steps of a suitable amplitude and not in a linear and continuous manner as results from the arrangement shown in FIG. 2. This may be achieved for example by employing guides 13 which are flexible or by constructing these guides in a plurality of segments suitably interconnected. With reference to FIG. 3, which shows the lower reach of the conveyor of a second embodiment of the invention, it will be observed that in providing guides 4' and 13' also on the lower reach of the conveyor for supporting the wheels 3 and 12 provided for the rollers 1 and 11 and in constructing the rest of the arrangement as described hereinbefore with respect to the upper reach of the conveyor, it is possible to employ also the lower reach of the conveyor for the calibration of the fruit Z. Further fruit-receiving conveyors A' are of course placed under this lower reach. Thus, by the addition of a small number of other members, it is possible to double the productivity of the machine, which is already high, with the obvious advantages of this possibility.

Having now described my invention what I claim as new and desire to secure by Letters Patent is:

1. A machine for sorting out in particular fruit in accordance with their size, said machine comprising a frame, an endless conveyor which has an upper reach and a lower reach, the upper reach of the conveyor being movable from one end to an opposite end of the conveyor relative to the frame and the lower reach of the conveyor being movable from said opposite end to said one end of the conveyor relative to the frame, the conveyor comprising flexible means and first rollers which are rotatively mounted on the flexible means, are equally spaced apart, are parallel to each other, define gaps between the first rollers, second rollers, means for mounting the second rollers on the flexible means so that the second rollers are rotatable, are respectively located in planes between adjacent first rollers, and movable upwardly and downwardly relative to the first rollers, independent and adjustable guide means carried by the frame and cooperative with the second rollers of the upper reach of the conveyor for displacing the second rollers of the upper reach of the conveyor progressively away from the first rollers of the upper reach of the conveyor as the upper reach of the conveyor moves toward said opposite end relative to the frame, and means for rotating the first rollers and second rollers of the upper reach of the conveyor in the same direction at a required speed, whereby the fruit, disposed in spaces existing between the first and second rollers in the upper reach of the conveyor, is driven in rotation as the upper reach of the conveyor moves toward said opposite end and drops from said spaces when the second rollers move progressively away from the first rollers and the spacing between the first and second rollers is equal to or greater than the equatorial dimension of the fruit, second guide means for guiding the lower reach of the conveyor as the lower reach of the conveyor moves from said opposite end to said one end of the conveyor, the first rollers and second rollers of the lower reach of the conveyor being devoid of means for driving them in rotation and said second guide means being inoperative to drive the first rollers and second rollers of the lower reach of the conveyor in rotation, and means provided below the conveyor for receiving the fruit thus sorted out into different sizes.

2. A machine for sorting out in particular fruit in accordance with their size, said machine comprising a frame, an endless conveyor which has an upper reach and a lower reach, the upper reach of the conveyor being movable from one end to an opposite end of the conveyor relative to the frame and the lower reach of the conveyor being movable from said opposite end to said one end of the conveyor relative to the frame, the conveyor comprising flexible means and first rollers which are rotatively mounted on the flexible means, are equally spaced apart, are parallel to each other and define gaps between the first rollers, second rollers, means for mounting the second rollers on the flexible means so that the second rollers are rotatable, are respectively located in planes between adjacent first rollers and are movable upwardly and downwardly relative to the first rollers, independent and adjustable guide means carried by the frame and cooperative with the second rollers of the upper reach of the conveyor for displacing the second rollers of the upper reach of the conveyor progressively away from the first rollers of the upper reach of the conveyor as the upper reach of the conveyor moves toward said opposite end relative to the frame, and means for rotating the first rollers and second rollers of the upper reach of the conveyor in the same direction at a required speed, further guide means carried by the frame and provided in association with the second rollers of the lower reach of the conveyor and operative on the second rollers of the lower reach of the conveyor to move the second rollers of the lower reach of the conveyor progressively away from the first rollers of the lower reach of the conveyor as the lower reach of the conveyor moves from said opposite end to said one end of the conveyor, means for rotating all the rollers in the lower reach of the conveyor in the same direction, whereby the fruit, disposed in spaces existing between the first and second rollers of both reaches of the conveyor is driven in rotation, as the reaches of the conveyor move, and drops from said spaces when the second rollers move progressively away from the first rollers and the spacing between the first and second rollers is equal to or greater than the equatorial dimension of the fruit, and means disposed below each of the reaches of the conveyor for receiving the fruit thus sorted out into different sizes.

* * * * *